United States Patent [19]

Funk

[11] Patent Number: 4,650,496

[45] **Date of Patent: * Mar. 17, 1987**

[54] PROCESS FOR MAKING A CARBONACEOUS SLURRY

[75] Inventor: James E. Funk, Alfred Station, N.Y.

[73] Assignee: Alfred University Research Foundation, Inc., Alfred, N.Y.

[ * ] Notice: The portion of the term of this patent subsequent to Jan. 22, 2002 has been disclaimed.

[21] Appl. No.: 732,604

[22] Filed: May 10, 1985

Related U.S. Application Data

[63] Continuation-in-part of Ser. No. 270,853, Jun. 10, 1981, which is a continuation of Ser. No. 88,815, Oct. 26, 1979, Pat. No. 4,282,006, which is a continuation-in-part of Ser. No. 957,166, Nov. 2, 1978, abandoned, which is a continuation-in-part of Ser. No. 790,337, Apr. 25, 1977, abandoned, which is a continuation-in-part of Ser. No. 484,686, Apr. 13, 1983, Pat. No. 4,526,584, which is a continuation-in-part of Ser. No. 375,183, May 5, 1982, Pat. No. 4,441,887, which is a continuation-in-part of Ser. No. 288,737, Jul. 31, 1981, Pat. No. 4,416,666, which is a continuation-in-part of Ser. No. 88,815.

[51] Int. Cl.[4] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 4,217,109 | 8/1980 | Siwersson et al. | 44/51 X |
| 4,441,888 | 4/1984 | Matt et al. | 44/51 |
| 4,494,959 | 1/1985 | Funk | 44/51 |
| 4,504,277 | 3/1985 | Scheffee | 44/51 |

*Primary Examiner*—Carl F. Dees

*Attorney, Agent, or Firm*—Howard J. Greenwald

[57] ABSTRACT

A process for preparing a carbonaceous slurry is provided. The process involves the steps of (1) providing a slurry with specified properties, and (2) thereafter mixing said slurry. The slurry provided in the first step of this process contains from at least about 60 weight percent of sold carbonaceous material (such as coal), no more than about 40 weight percent of carrier liquid, and from about 0.1 to about 4.0 weight percent (by weight of dry carbonaceous material in the slurry) of dispersing agent. At least about 5 weight percent of the carbonaceous particles in the slurry provided in the first step are of colloidal size, being smaller than about 3.0 microns. The Brookfield viscosity of the slurry provided in the first step is less than 4,000 centipoise.

The mixing step of the process of this invention improves the properties of the slurry provided, decreasing its viscosity.

10 Claims, 3 Drawing Figures

PROCESS FOR MAKING A CARBONACEOUS SLURRY

CROSS-REFERENCES TO RELATED APPLICATIONS

This application is a continuation-in-part of applicant's copending application U.S. Ser. No. 270,853 filed June 10, 1981, which was a continuation of application U.S. Ser. No. 088,815 filed Oct. 26, 1979 (now U.S. Pat. No. 4,282,006), which was a continuation-in-part of application U.S. Ser. No. 957,166 filed Nov. 2, 1978 (now abandoned), which was a continuation-in-part of application U.S. Ser. No. 790,337 filed Apr. 25, 1977 (now abandoned).

This application also is a continuation-in-part of applicant's copending application U.S. Ser. No. 484,686 filed Apr. 13, 1983, now U.S. Pat. No. 4,526,584 which was a continuation-in part of U.S. Ser. N. b 375,183 filed May 5, 1982 (now U.S. Pat. No. 4,441,887), which was a continuation-in-part of U.S. Ser. No. 288,737 filed July 31, 1981 (now U.S. Pat. No. 4,416,666), which was a continuation-in-part of application U.S. Ser. No. 088,815 filed Oct. 26, 1979.

BACKGROUND OF THE INVENTION

1. Technical Field

This invention describes a process for preparing a carbonaceous slurry involving the steps of (1) providing a carbonaceous slurry with specified properties, and (2) mixing said slurry. It is believed that at least one of the search classes relevant to the invention of this case is 44/51.

2. DESCRIPTION OF RELATED ART

Prior art teachings regarding the solids content of a coal-water slurry and its effect upon pumpability The prior art appears to disclose that, in coal-water slurries, when the solids content exceeds a certain critical value, the slurry becomes unpumpable.

An early patent, issued in September of 1920, places this critical value at about 20 weight percent of coal. U.S. Pat. No. 1,390,230 of Bates discloses that "Attempts have been made to carry or force coal through pipes by means of water, but owing to rapid sedimentation it has been possible to convey as a maximum only about 20% by weight of particles under considerable head of water travelling some twenty feet per second. Save under such exceptional circumstances or in rivers, water has not served as a carrier to transport coal. Only very small amounts may be made into a collidal with water, and so made naturally stable for transportation." (At lines 48–59 of page 1) In May of 1957, when Clancey et al. issued U.S. Pat. No. 2,791,471, this "critical value" was placed somewhat higher. At lines 13–19 of Column 2 of this patent, it is taught that "... coal at the slurry preparation terminal ... is mixed with water to form a slurry .... The resulting slurry should contain about 35 to 55 percent coal by weight." A similar disclosure appears in U.S. Pat. No. 2,791,472 of Barthauer et al., which also issued in May of 1957. At lines 45–49 of the Barthauer et al. patent, it is disclosed that "Coal selected for pipeline shipment is crushed to a suitable size consist, screened and mixed with water to form the slurry for transportation. The resulting slurry should contain about 35 to about 55 percent coal by weight."

In January of 1960, Wasp et al. issued U.S. Pat. No. 2,920,923. In this patent, they discussed the prior art Clancey et al. process and stated that "Certain hydraulic principles relating to pipeline transportation have been set forth in U.S. Pat. No. 2,971,471. A commercial pipeline, embodying these hydraulic principles, has been constructed in Ohio .... This coal is mixed with an equal weight of water to comprise a 50 percent aqueous coal slurry." (Lines 24–38 of Column 1)

In January of 1963, U.S. Pat. No. 3,073,652 was issued to Reichl. The Reichl patent appears to disclose that the aforementioned "critical value" of solids content could be as high as 60 weight percent. At lines 30–40 of Column 1, it is stated that "The coal particles, that is both the fine and coarse particles, are mixed with water to form a coal-water slurry having a solids concentration of between 35 and 60 percent by weight coal particles. It has been discovered that a slurry prepared as described above is dynamically stable in that the tendency of the larger sized coal particles to settle out of the slurry is reduced .... " However, as is taught in the Cole et al. patents, the coal concentrations taught in Reichl appear to be calculated on a "wet basis" and, thus, apparently correspond to "dry basis" coal concentrations of up to about 45 weight percent.

In February of 1965, U.S. Pat. No. 3,168,350 was issued to Phinney et al. in the Phinney et al. patent, reference is again made to the prior art Clancey et al. process disclosed in U.S. Pat. No. 2,791,471. With regard to the Clancey process, Phinney et al. stated that "The process employed to transport the coal as an aqueous slurry through the commercial pipeline is set forth in U.S. Pat. No. 2,791,471 .... The coal particles having the above size distribution and nominal top size are mixed with water to prepare a slurry comprising 35–55 percent by weight of the coal particles and the remainder water." (Lines 25–37 of Column 1)

In December of 1976, a U.S. patent issued which disclosed that, at above a solids centent of 50 percent of coal (dry basis), a slurry is unpumpable. U.S. Pat. No. 3,996,026 of Cole disclosed that "Ordinarily, a pumpable slurry of solid fuel or coal requires the addition of water to the powdered fuel to form a slurry containing not more than about from 40 to 45 wt. % coal. As the solids content increases above this range the slurry becomes increasingly difficult to pump and at about 50% solids content, it is umpumpable." (at lines 29–36 of Column 1) Cole also teaches that the as-mined coal cntains a substantial amount of moisture and, unless it is dried, a slurry containing 50 weight percent of such as-mined coal in fact contains substantially less than 50 weight percent of coal. At lines 37–47 of his patent, he discloses that "Actually such slurries contain in excess of 50% water as there is a considerable amount of water in coal as mined .... The coal or solid fuel also contains chemically bound water ... depending on the type of solid a fuel, a pumpable slurry may contain as little as 30 to 35 wt. % solids on a dry basis."

In May of 1978, yet another patent issued disclosing that a pumpable coal-water slurry could contain no more than about 40 to about 45 weight percent of coal. U.S. Pat. No. 4,088,453 disclosed that "The amount of water necessary to form a pumpable slurry depends on the surface characteristics of the solid fuel ... in the case of a slurry made up of solid fuel particles most of which will pass through a 200 mesh sieve it has been found that, ordinarily, a pumpable slurry must contain from 55 to 60 wt. % water." (Column 1, lines 25–46)

In August of 1978, U.S. Pat. No. 4,094,035 issued to Cole et al. It also contained disclosure that a coal-water slurry with more than 50 weight percent of coal was umpumpable; the portion of U.S. Pat. No. 3,966,026 quoted above was included verbatim in the Cole et al. U.S. Pat. No. 4,104,035.

Prior art teaching mixing a carbonaceous slurry after it has been ground

U.S. Pat. No. 4,465,495 of Schefee discloses a process for preparing a carbonaceous slurry comprising the steps of (1) providing a carbonaceous slurry with specified properties, and (2) subjecting the slurry to mixing at a shear rate of at least 100 sec.$^{-1}$.

Applicant's U.S. Pat. No. 4,282,066 was cited during the prosecution of the Schefee patent application. In an amendment filed Feb. 3, 1982 (in U.S. Ser. No. 197, at page 14), Schefee argued that the Funk patent did not disclose the allegedly critical particle size distribution required by Scheffee.

The effective filing date claimed for U.S. Pat. No. 4,465,495 is Oct. 17, 1980, the filing date of abandoned parent case Ser. No. 197,853.

SUMMARY OF THE INVENTION

A process for preparing a carbonaceous slurry, comprising the steps of (1) providing a slurry with specified properties, and (2) thereafter mixing said slurry, is disclosed. The slurry provided in the first step of the process of this invention contains from about 60 to about 80 weight percent of carbonaceous material (such as coal) and from about 20 to about 40 weight percent of carrier liquid. At least about 5 weight percent of the carbonaceous particles in the slurry are of colloidal size, being less than 3.0 microns in size. The Brookfield viscosity of the slurry, measured at a shear rate of 60 r.p.m., is less than 4,000 cps. The carbonaceous particles in the slurry have a particle size range of about 300×0.1 microns.

BRIEF DESCRIPTION OF THE DRAWINGS

The present invention will be more fully understood by reference to the following detailed description thereof, when read in conjunction with the attached drawings, wherein like reference numbers refer to like elements and wherein.

DESCRIPTION OF THE PREFERRED EMBODIMENTS

Figure 1:
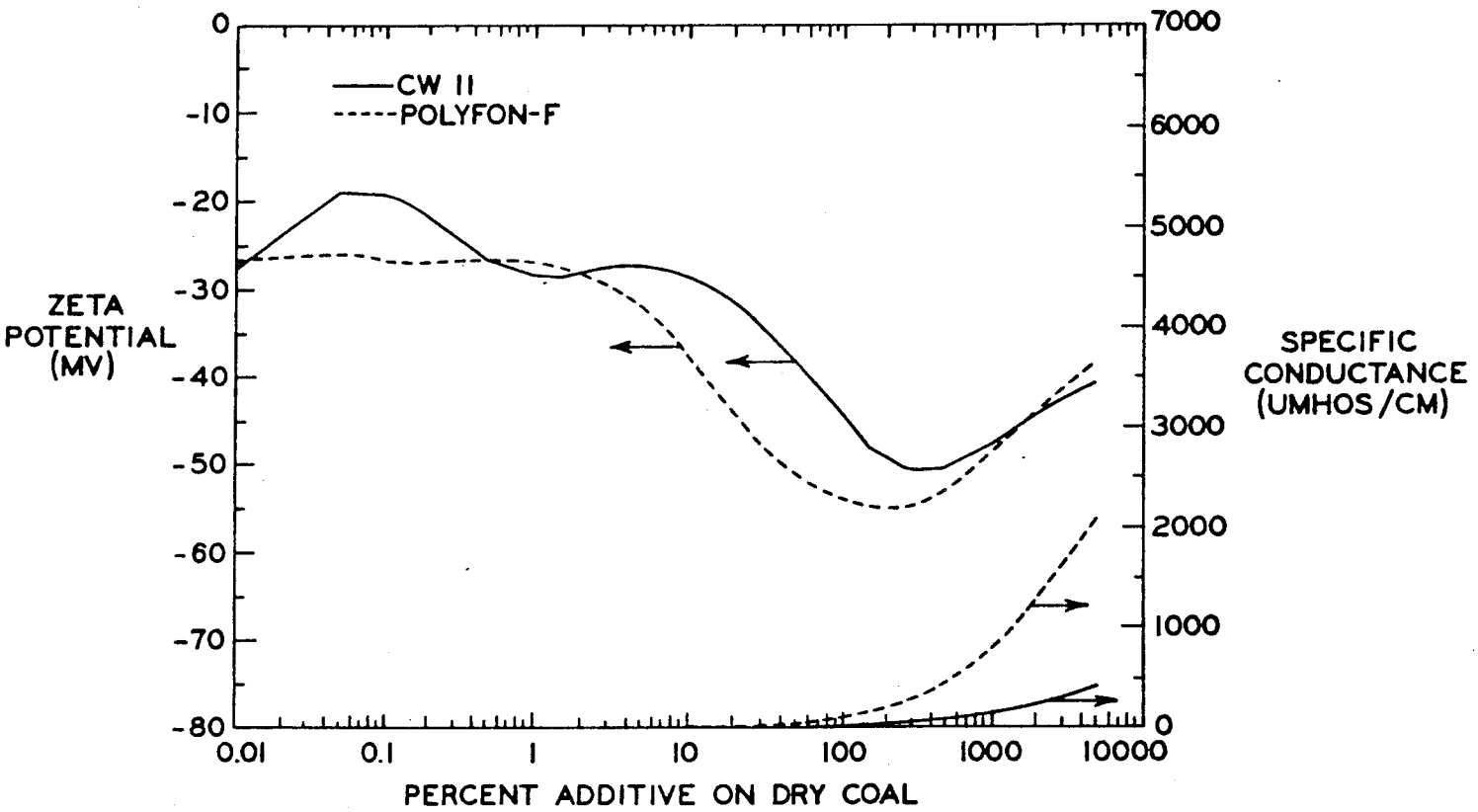
FIG. 1 is a chart showing the correlation between the zeta potential of coal particles in a fluid and the specific conductance of the fluid as a function of percent dispersing agent added to the fluid for two candidate dispersants.

In the process of this invention, it is preferred to use a grinding mixture which contains from about 60 to about 82 parts by volume of carbonaceous material and from about 18 to about 40 parts by volume of carrier liquid. In addition, the grinding mixture may also optionally contain from about 0.01 to about 4.0 parts, by weight of dry carbonaceous material in the mixture, of dispersing agent. It is preferred that the pH of the grinding mixture be from about 5 to about 12.

The grinding mixture can be provided either prior to or during grinding. In one embodiment, the carbonaceous material, carrier liquid, and optional dispersant are mixed to provide the grinding mixture, and the mixture so provided is then ground to produce a stable slurry. The aforementioned materials can be mixed by means well known to those skilled in the art including, e.g., blending them together, grinding them together, and combinations of blending them together and grinding them together. In another embodiment, all of the carbonaceous material desired in the grinding mixture is mixed with less than all of the carrier liquid and/or dispersant desired in the grinding mixture, and the incomplete mixture is then ground while the remainder of the carrier liquid and/or the dispersant is added during grinding; in this embodiment, the desired grinding mixture is generated in situ during grinding. In another embodiment, less than all of the carbonaceous material desired in the grinding mixture is mixed with carrier liquid and optional dispersant, and the incomplete mixture is then ground while the remainder of the carbonaceous material is added during grinding; in this embodiment, the desired grinding mixture is also generated in situ during grinding. Other embodiments will be apparent to those skilled in the art.

As used in this specification, the terms "mixed" and "mixing" refer to the steps of combining or blending several masses into one mass and include, e.g., blending, grinding, milling, and all other steps by which two or more masses are brought into contact with each other and combined to some extent. Conventional means for mixing viscous materials can be used in this invention. Thus, by way of illustration and not limitation, one can use batch mixers such as change-can mixers, stationary tank mixers, gate mixers, shear-bar mixers, screw-discharge batch mixers, intensive mixers, roll mills, bulk blenders, Littleford-Lodige mixers, cone and screw mixers, pan muller mixers, and the like. One can use continuous mixers such as single-screw extruders, the Rietz extruder, the Baker Perkins Ko-Kneader, the Transfer-Mixer, the Baker Perkins Rotofeed, twin-screw continuous mixers, trough and screw mixers, pug mills, the Kneadermaster, and the like.

The grinding mixture is preferably comprised of at least one carbonaceous solid material. As used in this specification, the term "carbonaceous" refers to a carbon-containing material and includes, by way of illustration and not limitation, coal, coke, graphite, charcoal, char, and the like. The preferred carbonaceous materials are carbonaceous fuels.

In one preferred embodiment, the carbonaceous solid material is coal. By way of illustration, anthracite, semi-anthracite, medium and high-volatile bituminous, sub-bituminous, and lignite coals can advantageously be used to practice this invention.

The coal for use in the invention can be obtained in a dry or wet form and mixed with fluid to form a coal-fluid mixture.

In view of the manner in which coal fractures during milling, coal particles will have irregular shapes which, however, are of a body (or maximum side-to-side thickness) such that the sub-sieve sized discrete particles will pass through a specified mesh of a sieve. The size of the discrete particle can be expressed in terms of a spherical diameter which, as used herein, is defined as a U.S. sieve size of from 4 mesh (4760 microns) to 400 mesh (38 microns) through which a coal particle from a sample of coal or coal-water slurry will pass. For particles finer than 200 mesh (74 microns), the size of the particles can be determined by means of a sieve, or a sedimentometer, or a scanning electron microscope (SEM), or the like.

In one preferred embodiment, the carbonaceous solid material is coke. Coke is the solid, cellular, infusible material remaining after the carbonization of coal, pitch, petroleum residues, and certain other carbonaceous materials. The varieties of coke, other than those from coal, generally as identified by prefixing a word to indicate the source, e.g., "petroleum coke". To indicate the process by which a coke is manufactured, a prefix also is often used, e.g., "beehive coke".

By way of illustration and not limitation, petroleum coke can be used in this invention. There are at least two types of petroleum coke: delayed coke, and fluid coke. Delayed coke generally contains from about 8 to about 18 weight percent of volatile matter, has a grindability index of from about 40 to about 60, and has a true density of from about 1.28 to about 1.42 grams per milliliter. Fluid coke generally contains from about 3.7 to about 7 weight percent of volatile matter, has a grindability index of from about 20 to about 30, and has a true density of from about 1.5 to about 1.6 grams per milliliter.

Other carbonaceous materials which can be used in this invention include, .e.g., high temperature coke, foundry coke, low temperature coke, medium temperature coke, pitch coke, char, charcoal, solvent refined coal, and mixtures of one or more of said carbonaceous materials with coal and/or petroleum coke. Mixtures of coal and petroleum coke can be used in this invention. When using said mixtures, it is preferred that from about 1 to about 20 weight percent of the carbonaceous material be petroleum coke and that from about 80 to about 99 weight percent of the carbonaceous material be coal.

In general, any carbonaceous fuel can be used as the solid carbonaceous material in the invention.

Mixtures of carbonaceous solids can be used. By way of illustration and not limitation, one can use a mixture of at least one coarse carbonaceous fraction which contains less than about 30 weight percent of volatilizable hydrocarbons (such as, e.g., anthracite or low volatile bituminous coal) and at least one fine carbonaceous fraction which contains more than about 35 weight percent of volatilizable hydrocarbons (such as, e.g., lignite or high volatile bituminous coal). One can use a mixture of two or more of said coarse carbonaceous fractions and one of said fine fractions, one of said coarse carbonaceous fractions and two or more of said fine fractions, or two or more of said coarse carbonaceous fractions and two or more of said fine fractions. In this embodiment, the grinding mixture is preferably comprised of from about 2 to about 50 weight percent of solid carbonaceous material which has a median particle size of from about 0.5 to about 40 microns and from about 50 to about 98 weight percent of solid carbonaceous material which has a median particle size in excess of 40 microns.

In one embodiment, the grinding mixture is comprised of at least two consists of carbonaceous material. As used in this specification, the term "consist" means the particle size distribution of the solid phase of the carbonaceous material/fluid slurry. For example, the term "8 mesh×0", when used with reference to a coal-water slurry, indicates coal with a graded size, or consist, of coal particles distributed in the range of 8 mesh and zero, or 2360 microns×zero microns. Similarly, the term "about 1180 microns×0.05 microns", indicates coal with a nominally measurable graded size, or "consist", of coal particles distributed in the range of from about 1180 microns to a measurable colloidal size, e.g., of at least about 0.05 microns. The term "about 1180 microns" is nominally equivalent to a U.S. Series 16 mesh sieve, substantially as defined in "Handbook of Chemistry and Physics", 54th Edition, 1973–1974, CRC Press, Cleveland, Ohio, page 143, "Standard Test Sieves(wire cloth)", the disclosure of which is hereby incorporated by reference into this specification.

Unless otherwise stated in this specification, the weight of carbonaceous material is on a moisture-free or "dry basis" herein. Thus, e.g., the "solids" in as-mined carbonaceous material include, e.g., carbonaceous material and ash. Thus, there is a considerable amount of bound water in coal as mined; the volume of this water in the coal is not included in the solids weight in order to calculate the volume percent of "dry solids" in the grinding mixture used in this invention. Thus, as used herein, the term "dry basis" refers to coal (and/or other carbonaceous material) which is substantially free of carrier liquid. Carbonaceous material is considered to be dry after it has been air dried by being exposed to air at a temperature of at least 70 degrees Fahrenheit and a relative humidity of less than 50 percent for at least 24 hours.

In one preferred embodiment, at least two consists of carbonaceous material are mixed with carrier fluid to prepare the grinding mixture. Both of said consists of carbonaceous material can be produced by wet grinding; thus, e.g., one of the consists can be produced by grinding coal at a high solids content (60–82 volume percent) in the presence of water and, optionally, surfactant, the second of the consists can be produced by grinding coal at a lower solids content (30–60 volume percent) in a ball mill or a stirred ball mill, and the first and the second coal consists can be ground together with each other (and, optionally, with one or more additional consists produced by wet and/or dry grinding) at a solids content of from about 60 to about 82 volume percent in the optional presence of from about 0.01 to about 4.0 weight percent of dispersant and water. Alternatively, both of said consists of carbonaceous material can be produced by dry grinding; thus, e.g., one of the consists can be prepared by grinding one pulverized coal (i.e., coal which has been milled or ground to a consist of about 20 mesh by 0) in, e.g., a ring roller mill, a second or more of the consists can be prepared by dry grinding a second pulverized coal in, e.g., a micronizer fluid energy (jet) mill, and the two ground dry fractions are then blended in a blending tank at a solids concentration of from 60–90 volume percent with water and, optionally, 0.01 to 4.0 weight percent of dispersant at a high shear stress in a mixer such as a Greerco inline mixer. Alternatively, at least one of said consists can be produced by wet grinding, and at least one of said consists can be produced by dry grinding; thus, e.g., one of the consists can be produced by wet grinding coal at a low solids content (30–60 volume percent) in the presence of water and, optionally, dispersant, a second of the consists can be produced by dry grinding pulverized coal in either a micronizer fluid energy (jet) mill, or a ring roller mill, and the consists produced by wet and dry grinding are then blended in a blending tank at a solids concentration of 60–82 volume percent water and, optionally, 0.01 to 4.0 weight percent of dispersant at a high shear stress in a mixer such as a Greerco inline mixer. Alternatively, one can prepare the grinding mixture by wet grinding (or regrinding) slurry comprised of carbonaceous material to produce the fine consist for the mixture. Thus, by way of illustration, a fine consist can be prepared by regrinding a "final slurry" product at a concentration of from about 40 to about 60 weight percent solids (and preferably at from about 45 to about 55 weight percent of solids) in, e.g., a stirred ball mill until the median particle size of the slurry is from about 4 to about 20 microns. The coarse consist can be produced by dry crushing (in, e.g., a roll crusher, a gyratory crusher, a cage mill, etc.) the carbonaceous material to a nominal $\frac{3}{8}'' \times 0$ size so that the median particle size of the coarse fraction exceeds 40 microns. The coarse and fine fractions can then be combined with each other, carrier liquid, and dispersing agent to produce a grinding mixture comprised of from about 60 to about 82 volume percent of carbonaceous material, from about 18 to about 40 volume percent of carrier liquid, and from about 0.01 to about 4.0 weight percent of dispersant.

The fine consist in this particular embodiment can alternatively be made by grinding a dry pulverized coal at a concentration of from about 40 to about 60 weight percent solids until the median particle size of the fine consist is from about 4 to about 20 microns.

Figure 2:
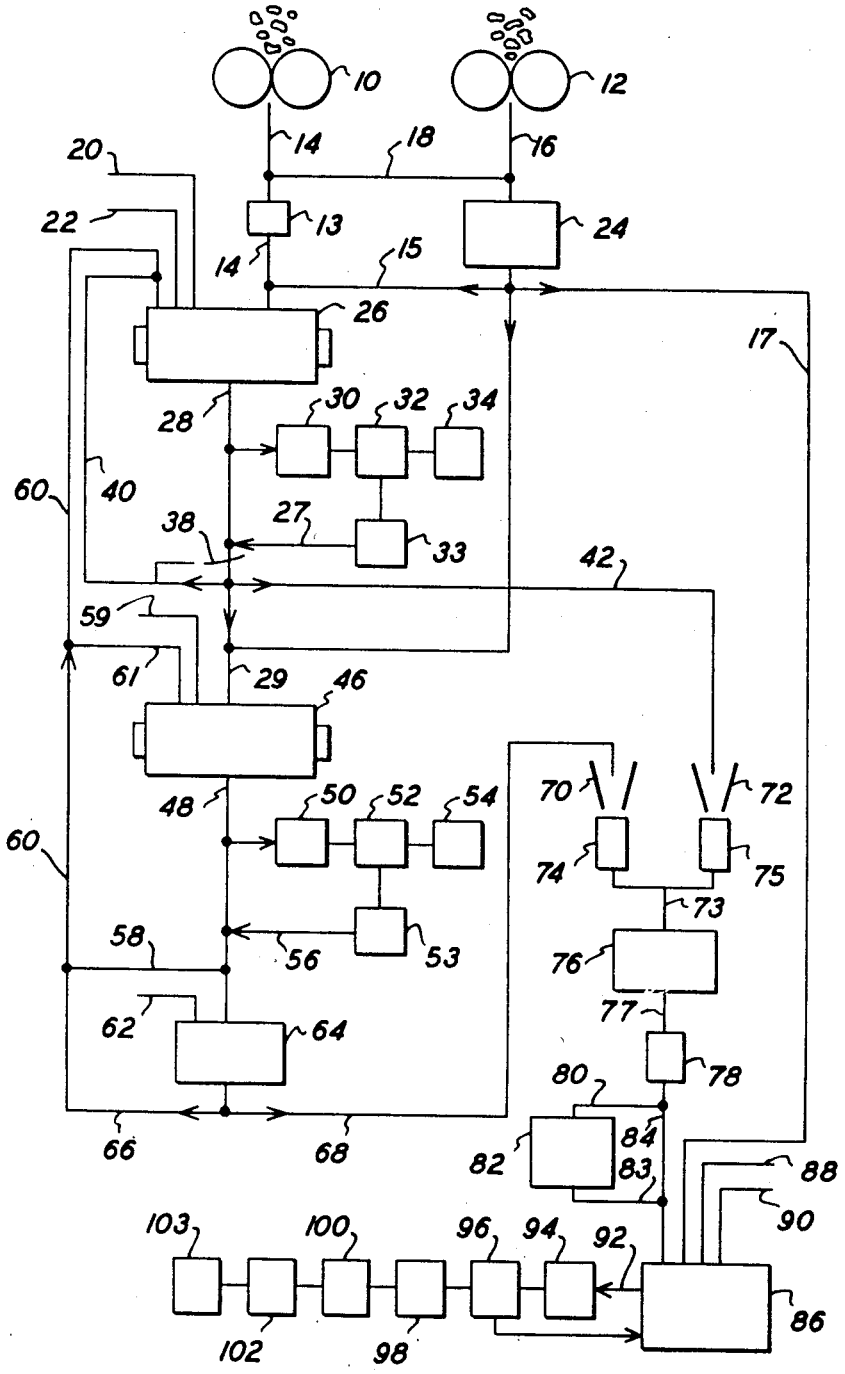
FIG. 2 is a flow sheet of one preferred process for making the slurry used in the process of this invention.

The aforementioned processes are all illustrated in FIG. 2.

In one of the preferred grinding mixtures used in the invention, the solid carbonaceous material consists essentially of at least one fine solid carbonaceous material and at least one coarse solid carbonaceous material. From about 2 to about 50 weight percent of the solid carbonaceous material in this grinding mixture can be comprised of fine solid carbonaceous material with a median particle size of from about 0.5 to about 40 microns; it is preferred that from about 4 to about 40 weight percent of the solid carbonaceous material in this grinding mixture be comprised of fine solid carbonaceous material with a median particle size of from about 1 to about 30 microns; and it is even more preferred that from about 6 to about 30 weight percent of the solid carbonaceous material in this preferred grinding mixture be comprised of fine solid carbonaceous material with a median particle size of from about 2 to about 20 microns. From about 50 to about 98 weight percent of the solid carbonaceous material in the grinding mixture can be comprised of coarse solid carbonaceous material with a median particle size greater than 40 microns.

In one preferred embodiment, the grinding mixture can contain one fine carbonaceous solid fraction or several fine carbonaceous solid fractions, which may be the same or different carbonaceous materials; regardless of whether one or several such fine fractions are present in this grinding mixture, from about 2 to about 50 weight percent of the solid carbonaceous material in this grinding mixture has a median particle size of from about 0.5 to about 40 microns.

In one preferred embodiment, the grinding mixture contains from about 60 to about 96 weight percent of coarse solid carbonaceous material with a median particle size greater than 40 microns. It is more preferred that from about 70 to about 94 weight percent of the grinding mixture be comprised of said coarse solid carbonaceous material with a median particle size greater than 40 microns.

In one embodiment, the grinding mixture is prepared by preferably mixing the carbonaceous solid with from about 0.01 to about 4.0 weight percent of dispesing agent. In the case where at least two consists of carbonaceous solid material are mixed with liquid, (1) both of the consists can be dry ground and mixed with liquid and dispersant; (2) the dispersant can be mixed with the liquid, and the dry ground consists can be mixed with the liquid-dispersant mixture; (3) one of the consists can be dry ground, a second of the consists can be wet ground with part or all of the dispersant, and the ground consists can be mixed with the balance of the liquid and the dispersant which was not theretofore mixed with the consists; (4) some or all of the dispersant can be wet ground with one or both of the consists, and the ground consists can then be mixed with the liquid and the balance of the dispersant which was not theretofore mixed with the consists; and (5) one or more consists can be wet ground with no dispersant and insufficient total water and then blended with dispersant and the balance of the water and/or other consist blends.

The grinding mixture used preferably contains from about 60 to about 82 volume percent of one or more carbonaceous solid materials. It is preferred that said grinding mixture contain from about 64 to about 81 volume percent of said carbonaceous solid material. In a more preferred embodiment, the grinding mixture contains from about 75 to about 80 volume percent of said solid carbonaceous material.

The grinding mixture used generally has a pH of from about 5 to about 12. It is preferred that the pH of the grinding mixture be from about 7 to about 11.

The grinding mixture used is comprised of one or more liquids. As used in this specification, the term "liquid" refers to a substance which undergoes continuous deformation under a shearing stress. The liquid used in the grinding mixtures preferably performs at least two functions—it fills the interstitial pores of the carbonaceous solid material, and it provides the vehicle for separation of the particles of the carbonaceous solid material to minimize collisions between said particles; thus, the preferred liquid is a carrier liquid.

By way of illustration and not limitation, some of the liquids which can be used in the grinding mixture include: water; waste industrial solvents such as, e.g., effluents from waste disposal plants, contaminated waste water containing hydrocarbons from, e.g., oil-separation processes, and the like; aromatic and aliphatic alcohols containing 1–10 carbon atoms, such as methanol, ethanol, porpanol, butanol, phenol, mixtures thereof, and the like; pine oil; petroleum liquids such as, e.g., number 2 fuel oil, number 4 fuel oil, number 6 fuel oil, gasoline, naphtha, mixtures thereof, and the like; hydrocarbon solvents such as, e.g., benzene, toluene, xylene, kerosene, and derivatives thereof; acetone; aniline; anisole; halobenzenes such as, e.g., bromobenzene and chlorobenzene; nitrobenzene; carbon tetrachloride; chloroform; cyclohexane; n-decane; dodecane; 1,1,2,2-tetrachloroethane; ethyl bromide; 1,2-dichloroethylene; tetrachloroethylene; trichloroethylene, ethylene chloride; ethyl ether; ethyl iodide; glycol; n-hendecane; n-heptane; 1-heptanol; 1-hexanol; methylene halides such as, e.g., methylene chloride, methylene bromide, and methylene iodide; n-octadecane; n-octane; 1-octanol; n-pentadecane; pentanol; and the like. The aforementioned list is merely illustrative.

In one preferred embodiment, the liquid used is carrier water. As used in this specification, the term "carrier water" means the bulk of free water dispersed between the carbonaceous particles and contiguous to the bound layers on the particles, and it is to be distinguished from bound water. The term "bound water" means water retained in the "bound water layer", as defined and illustrated in Kirk-Othmer, Encyclopedia of Chemical Technology, 2d Edition, Vol. 22, pages 90–97 (at p. 91).

When water is added to a carbonaceous powder comprised of finely divided particles, and if the water "wets" the powder, a surface water film is adsorbed on each particle which is known to be structurally different from the surrounding "free" or bulk water, in that the film may be described as "semi-rigid", or "bound water film". Depending on the fundamental electrical potential of the surface, this "semi-rigid" or bound water film may be of several molecules thickness.

Mixtures of at least two liquids can be used in the grinding mixture. Thus, by way of illustration, one can use mixtures comprised of from about 1 to about 99 volume percent of alcohol and from about 99 to about 1 volume percent of water. In one preferred embodiment, the mixture is comprised of from about 1 to about 15 volume percent of alcohol with the remainder of the liquid consisting essentially of water. In this embodiment, it is preferred that the alcohol be monohydric and that it contain from about 1 to about 10 carbon atoms. Suitable monohydric alcohols are listed on page 265 of Fieser and Fieser's "Advanced Organic Chemistry" (Reinhold, New York, 1961), the disclosure of which is hereby incorporated by reference into this specification.

In one embodiment, a mixture of water and petroleum liquid is used in the grinding mixture. In one aspect of this embodiment, at least about 90 weight percent of the carrier liquid is water and less than about 10 weight percent of the carrier liquid is petroleum liquid. In this aspect, it is preferred that the petroleum liquid be selected from the group consisting of number 2 fuel oil, number 4 fuel oil, number 6 fuel oil, gasoline, naphtha, high gas oil, low gas oil, catalytic cracked recycle oil, mixtures thereof, and other similar petroleum products. Vegetable oils, such as corn, bean, or pine oil, can also be used to replace part or all of the petroleum liquid.

The grinding mixture is preferably comprised of from about 18 to about 40 volume percent of one or more carrier liquids. It is preferred that the grinding mixture cntain from about 19 to about 36 volume percent of one or more carrier liquids. In the most preferred embodiment, the grinding mixture is comprised of from about 20 to about 25 volume percent of one or more carrier liquids.

In one embodiment, the grinding mixture contains from about 0.01 to about 4.0 weight percent of dispersing agent, based on the weight of dry carbonaceous material. In another embodiment, no dispersing agent is present in the grinding mixture.

For any given grinding mixture, the identity of the dispersing agent(s) which are most effective for that system can be determined by measuring the effects of the dispersant upon the system at a given dispersant concentration; viscosity versus shear rate of the stirred slurry is measured while titrating with increasing amounts of the dispersing agent; and the point at which the slurry viscosity ceases to decrease is noted. For any given dispersant(s), and system, the most effective concentration is the one which gives the minimum viscosity under a given set of test conditions, and the efficiency of different dispersants can be compared by testing them with a given system under comparable concentration and test conditions.

By way of illustration, one can grind a sample of coal in a laboratory size ball mill with porcelain or steel balls in water at 50 weight percent solids until all of the particles in the coal are less than 10 microns in size. Small samples (about 500 milliliters apiece) of the system can then be deflocculated by adding various dispersing agents to the samples dry or preferably in solution dropwise, blending the mixture at any consistent blending energy (which may be gentle, as mixing by hand, or at very high shear energy which will improve dispersion), and then measuring the viscosity at some constant shear rate by, e.g., using a Brookfield RVT viscometer at 100 revolutions per minute. The dispersing agent (or combination of dispersing agents) which is found to produce the lowest viscosity for the system at a given shear rate and dispersing agent(s) concentration is the most effective for those conditions.

FIG. 1 illustrates one means of evaluating te effectiveness of surfactants for any given solid material. The curves of FIG. 1 represent data obtained using both a purported nonionic polymer CW-11 made by the Diamond Shamrock Process Chemicals Co. and an anionic lignosulfonate Polyfon-F made by Westvaco, Inc., adsorbed on an Australian coal. The fine coal, ground to about 100% finer than 10 microns, is slurried in distilled water at 0.01 weight percent solids. Aliquots are placed in test tubes, and increasing amounts of any candidate surfactant are added to each test tube. The test tube samples are thoroughly mixed and inserted into a sampler carousel. The Pen Kem System 3000 Electrophoretic Mobility Analyzer automatically and sequentially samples each test tube and measures the electrophoretic mobility of the coal particles and the specific conductance of the carrier liquid; pH can also be measured on each sample. In FIG. 1 the left ordinate gives the calculated zeta potential of the particles in millivolts, the right ordinate gives the specific conductance in micromhos of the carrier liquid. These variables are both measured as a function of the percent addition of each surfactant on a dry coal basis which is plotted on the abscissa. FIG. 1 shows that the purported nonionic CW-11 surfactant does have some anionic character. CW-11 has a zeta potential of −50 m.v. at 300% addition at 0.01% dry coal. Polyfon-F has a zeta potential of −55 m.v. at 200% addition on 0.01% dry coal. Furthermore, the specific conductance of the Polyfon-F at −55 m.v. zeta potential is greater than CW-11 at −50 m.v. These data establish Polyfon-F as a more chemically effective surfactant for use on this particular Australian coal.

The amount of dispersing agent(s) which can be used will vary, depending upon such factors as the concentration of the carbonaceous material in the slurry, the particle size and particle size distribution, the amount of ash minerals (i.e., clays and other minerals) present, the temperature of the slurry, the pH, the original zeta potential of the particles, the identity of the dispersing agent(s), etc. In general, the dispersing agent preferably is present in the slurry at a concentration of from 0.01 to 4.0 weight percent, by weight of dry coal.

In determining the amount of specific dispersing agent(s) needed, a series of measurements can be made of viscosities versus shear rates versus zeta potential for a series of solids-liquid slurries containing a range of amounts of a particular dispersing agent for a constant amount of solids-liquid slurry. The data can be plotted and used as a guide to the optimum quantities of that agent to use to obtain near maximum or maximum zeta potential for that system. The coordinate of the chart at which the viscosity and/or zeta potential is not changed significantly by adding more agent is selected as an indication of the optimum quantity at maximum zeta potential, and the amount is read from the base line of the chart. The viscosity and amount read from the titration chart is then compared with an equivalent chart showing a correlation between viscosity, amount, and maximum zeta potential. An amount of electrolyte and/or dispersing agent(s) required to provide a maximum or near maximum zeta potential and a selected viscosity can then be used to make a solids-liquid slurry.

Any dispersing agent which disperses the carbonaceous particles in the water can be used. The dispersing agent can be inorganic. Thus, .e.g., sodium hydroxide can be used with some carbonaceous materials. The dispersing agent can be, and preferably is, organic, i.e., it contains carbon.

It is preferred that the dispersing agent be an organic surfactant selected from the group consisting of anionic surfactants, nonionic surfactants, cationic surfactants, and amphoteric surfactants. The molecular weight of the dispersing agent should be at least about 200.

In one embodiment, the dispersing agent is an anionic surfactant whose solubilizing group is selected from the group consisting of a carboxyalte group, a sulfonate group, a sulfate group, a phosphate group, and mixtures thereof. By way of illustration, one of these preferred anionic surfactants is a polyacrylate of the formula

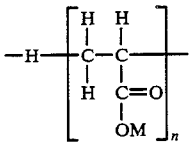

wherein n is a whole number of at least 3 and M is selected from the group consisting of hydrogen, sodium, potassium, and ammonium.

In another embodiment, the surfactant is cationic and its solubilizing group(s) is selected from the group consisting of a primary amine group, a secondary amine group, a tertiary amine group, a quaternary ammonium group, and mixtures thereof.

One preferred surfactant is the alkali metal salt of a condensed mononaphthalene sufonic acid. This acid, whose prepration is described in U.S. Pat. No. 3,067,423 (the disclosure of which is hereby incorporated by reference into this specification), can be prepared by sulfonating naphthalene with sulfuric acid, condensing the sulfonated naphthalene with formaldehyde, and then neutralizing the condensate so obtained with sodium hydroxide or ammonium hydroxide. This alkali metal or ammonium salt of a condensed mono naphthalene sulfonic acid is comprised of at least 85 weight percent of a repeating structural unit of the formula

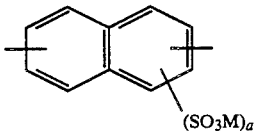

wherein M is a metal selected from the group consisting of sodium, potassium and ammonium, and a is an integer of from 1 to 8. Comparable compounds with a benzene rather than naphthalene nucleus also can be used.

Some of the surfactants sold by the Diamond Shamrock Chemical Company of Morristown, N.J. can be used in this invention. Thus, one can use surfactants such as Lomar D (the sodium salt of a condensed mono naphthalene sulfonic acid), Lomar PW (sodium neutralized naphthalene sulfonic acid), Lomar PWA (ammonium salt of a condensed mono naphthalene sulfonic acid), A23, Nopcosperse VFG (condensed alkyl naphthalene sulfonate), and Nopcosperse VEO (polymerized alkyl naphthalene sulfonate).

One class of surfactants which can be used in this invention is the polyalkylene oxide nonionic surfactants having a hydrophobic portion and a hydrophilic portion, wherein the hydrophilic portion comprises at least about 100 units of ethylene oxide. These surfactants are disclosed in U.S. Pat. No. 4,358,293, the disclosure of which is hereby incorporated by reference into this specification.

The polyalkyleneoxide nonionic surfactants suitable for use in the invention include the glycol ethers of alkylated phenols having a molecular weight of at least about 4,000 and being of the general formula:

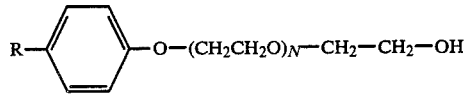

wherein R is substituted or unsubstituted alkyl of from 1 to 18 carbon atoms (preferably 9 carbon atoms), substituted or unsubstituted aryl, or an amino group; and n is an integer of at least about 100. The substituents on the alkyl and aryl radicals can include halogen, hydroxy, and the like.

Other suitable nonionic surfactants are the poly(oxyethylene)-poly(oxypropylene)-poly(oxyethylene) polymers, or as otherwise described propoxylated, ethoxylated propylene glycol nonionic surfactant block polymers having a molecular weight of at least about 6,000 and being of the general formula:

$$HO(CH_2CH_2O)_a[CH(CH_3)CH_2O]_b(CH_2CH_2O)_cH$$

wherein a, b, and c are whole integers and wherein a and c total at least about 100.

Still other polyalkyleneoxide nonionic surfactants suitable for use are the block polymers of ethylene and propylene oxide derived from nitrogen-containing compositions such as ethylene diamine and having a molecular weight of at least about 14,000 and being of the general formula:

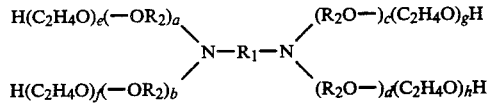

wherein $R_1$ is an alkylene radical having 2 to 5 carbon atoms, preferably 2; $R_2$ is an alkylene radical having 3 to 5 carbon atoms, preferably 3; a, b, c, d, e, f, g, and h are whole integers; and e, f, g, and h total at least about 100.

Another preferred class of surfactants is the lignosulfonates. These lignosuflonates have an equivalent weight of from about 100 to about 350, contain from about 2 to about 60 phenyl propane units (and, preferably, from about 3 to about 50 phenyl propane units), and are made up of cross-linked polyaromatic chains. Some of the preferred lignosulfonates include those listed on page 293 of McCutcheon's "Emulsifiers and Detergents", North American Edition (McCutcheon Division, MC Publishing Co., Glen Rock, N.J., 1981) and in the other portions of McCutcheon's which describes said lignosulfonates, the disclosure of which is hereby incorporated by reference into this specification. In one embodiment, the lignosulfonate surfactant contains from about 0.5 to about 8.0 sulfonate groups; in this embodiment, one species has 0.5 sulfonate groups, one has 1.0 sulfonate group, one has 2.0 sulfonate groups, one has 4.0 sulfonate groups, and one has 7.5 sulfonate groups.

It is preferred that the dispersing agent(s) used in this invention provide one or more ions to the system. As used in this specification, the term "ion" includes an electrically charged atom, an electrically charged radical, or an electrically charged molecule. In one preferred embodiment, the dispersing agent(s) used provides one or more counterions which are of opposite charge to that of the surface of the carbonaceous particles. The charge on the surface of the carbonaceous particles in water is generally negative, and thus it is preferred that said counterions have a positive charge. The most preferred positively charged ions are the sodium and potassium cations and the ammonium radical.

In one embodiment, it is preferred that the dispersing agent used in the invention be a polyelectrolyte which, preferably, is organic. As used in the specification, the term "polyelectrolyte" indicates a polymer which can be changed into a molecule with a number of electrical changes along its length. It is preferred that the polyelectrolyte have at least one site on each recurring structural unit which, when the polyelectrolyte is in aqueous solution, provides electrical charge; it is more preferred that the polyelectrolyte have at least two such sites per recurring structural unit. In one embodiment, said sites comprise ionizable groups selected from the group consisting of ionizable carboxylate, sulfonate, sulfate, and phosphate groups. Suitable polyelectrolytes include, e.g., the alkali and ammonium salts of polycarboxylic acids such as, for instance, polyacrylic acid; the sodium salt or the ammonium salt of condensed naphthalene sulfonic acid; polyacrylamide; and the like.

In one preferred embodiment, the grinding mixture contains from about 0.05 to about 4.0 weight percent, by weight of dry carbonaceous solids in the slurry, of an electrolyte which, preferably, is inorganic. As used in this specification, the term "electrolyte" refers to a substance that dissociates into two or more ions to some extent in water or in other polar solvent. The substance can be an acid, base, or salt.

It is preferred that the grinding mixture contain from about 0.05 to about 2.0 weight percent of inorganic electrolyte and, more preferably, from about 0.1 to about 0.8 weight percent of inorganic electrolyte. It is most preferred that the mixture contain from about 0.1 to about 0.5 weight percent of inorganic electrolyte.

Some suitable inorganic electrolytes which can be used in the grinding mixture include, e.g., the ammonium or alkali metal salt of hexametaphosphates, pyrophosphates, sulfates, carbonates, hydroxides, silicates, and halides, such as, e.g., potassium carbonate, sodium hydroxide, and ammonium hydroxide.

GRINDING THE GRINDING MIXTURE AT A REDUCED CRITICAL SPEED

In one preferred embodiment, the grinding mixture is ground in a tumbling mill which, preferably, is run at a reduced critical speed in order to produce the carbonaceous slurry of this invention.

A tumbling mill is any horizontally mounted cylindrical mill which tumbles its contents when rotating; see, e.g., E. J. Pryor's "Mineral Processing" (Mining Publications, Ltd., London, 2d ed., 1960), the disclosure of which is hereby incorporated by reference into this specification.

Suitable tumbling mills include ball mills, pebble mills, rod mills, tube mills, and compartment mills. As is disclosed on pages 8–25 to 8–29 of Robert H. Perry's and Cecil H. Chilton's "Chemical Engineers' Handbook", Fifth Edition (McGraw-Hill Book Company, New York, 1973), the disclosure of which is hereby incorporated by reference into this specification, "Ball, pebble, rod, tube, and compartment mills have a cylindrical or conical shell, rotating on a horizontal axis, and are charged with a grinding medium such as balls of steel, flint, or porcelain, or with steel rods. The ball mill differs from the tube mill by being short in length; its length, as a rule, is not far from its diameter . . . . Conventional ball mills use large balls on a coarse feed to produce a comparatively coarse product. The tube mill is usually long in comparison with its diameter, uses smaller balls, and produces a finer product. The compartment mill, a combination of the above types, consists of a cylinder divided into two or more sections by perforated partitions; preliminary grinding takes place at one end and finish grinding at the discharge end. Rod mills deliver a more uniform and more granular product than other revolving mills, thus minimizing the percentage of fines, which are sometimes detrimental. The pebble mill is a tube mill with flint or ceramic pebbles as the grinding medium and may be lined with ceramic or other non-metallic liners."

The preferred tumbling mill used in this invention is the ball mill.

It is preferred, when using a tumbling mill, that it be run at a reduced critical speed. As is disclosed on page 8–26 of Perry's and Chilton's "Chemical Engineer' Handbook", Fifth Edition, supra, critical speed is the theoretical speed at which the centrifugal force on a ball in contact with the mill shell at the height of its path equals the force on it due to gravity, and it is defined by the equation:

$$N_C = \frac{76.6}{\sqrt{D}}$$

wherein $N_c$ is the critical speed (in revolutions per minute), and D is the diameter of the mill (in feet).

It is preferred to run the tumbling mill at less than about 70 percent of its critical speed and, more preferably, at less than about 60 percent of its critical speed. It is most preferred to run the tumbling mill at less than about 55 percent of its critical speed. The use of reduced critical speed grinding produces a slurry with improved viscosity and stability properties.

PREPARATION OF THE CARBONACEOUS SLURRY

As indicated above, the aforementioned grinding mixture can be provided by mixing solid carbonaceous material, carrier liquid, and, optionally, dispersing agent. Thereafter, the grinding mixture can be wet ground until a carbonaceous slurry with specified properties is produced. Thus, in general, the grinding can be continued to produce a stable, solids-liquid slurry comprising a consist of finely-divided particles of solid carbonaceous material dispersed in said liquid, wherein:

(a) said slurry is comprised of at least about 60 volume percent of said solid carbonaceous material (dry basis), less than 40 volume percent of said liquid, and, optionally, from about 0.01 to about 4.0 weight percent (based on weight of dry solid carbonaceous material) of dispersing agent;

(b) said slurry has a Brookfield viscosity at a solids content of 70 volume percent, ambient temperature, ambient pressure, a shear rate of 100 revolutions per minute, of less than 5,000 centipoise;

(c) said consist has a specific surface area of from about 0.8 about 4.0 square meters per cubic centimeter and an interstitial porosity of less than 20 volume percent; and (d) from about 5 to about 70 volume percent of said particles of solid carbonaceous material are of colloidal size, being smaller than about 3 microns.

The slurry of this invention preferably contains from about 60 to about 82 volume percent of carbonaceous solid material and, more preferably, from about 64 to about 81 volume percent of carbonaceous solid material. In an even more preferred embodiment, the slurry contains from about 75 to about 80 volume percent of said solid carbonaceous material.

The slurry also preferably contains from about 18 to about 40 volume percent of carrier liquid and, more preferably, from about 19 to about 36 volume percent of carrier liquid. In an even more preferred embodiment, the slurry contains from about 20 to about 25 volume percent of carrier liquid.

The Brookfield viscosity of the slurry is less than about 5,000 centipoise. The Brookfield viscosity is tested after the solids content of the slurry is adjusted to a solids content of 70 volume percent (the slurry is either diluted or concentrated until it has this concentration of solids) at ambient temperature, ambient pressure, and a shear rate of 100 revolutions per minute. It is preferred that the viscosity of the slurry be less than 4,000 centipoise, and it is more preferred that said viscosity be less than 3,000 centipoise. In an even more preferred embodiment, the viscosity of the slurry is less than 2,000 centipoise. In the most preferred embodiment, the viscosity of the slurry is less than 1,000 centipoise.

The term "Brookfield viscosity", as used in this specification, describes viscosity as measured by conventional techniques by means of a Brookfield Synchro-Lectric Viscosimeter (manufactured by the Brookfield Engineering Laboratories, Stoughton, Mass., U.S.A.).

The carbonaceous slurry contains a consist of finely divided particles of solid carbonaceous material dispersed in liquid. Said consist has a specific surface area of from about 0.8 to about 4.0 square meters per cubic centimeter. It is is preferred that said specific surface area be from about 0.8 to about 3.0 square meters per cubic centimter. It is even more preferred that said specific surface area be from about 0.8 to about 2.4 square meters per cubic centimeter. In the most preferred embodiment, said specific surface area is from about 0.8 to about 2.0 square meters per cubic centimeter.

As used in this specification, the term "specific surface area" refers to the summation of the surface area of equivalent spheres in the particle size distribution as measured by sieve analysis and sedimentation techniques; the particle size distribution of the consist in the slurry is first determined, it is assumed that all particles in the consist are spherical, and then one calculates the surface area based upon this assumption. As used herein, the term "consist" refers to the particle size distribution of the solid phase of the solids-liquid slurry.

For any given consist, one can determine the particle size distribution by means well known to those skilled in the art. For measuring particle sizes and for determining particle size distributions of pulverized and fine grind carbonaceous particles used for preparing a carbonaceous slurry, the following two methods can be used:

(1) U.S. Series sieves numbers 16, 20, 30, 40, 50, 70, 100, 140, 200, 270, are used to determine weights of carbonaceous particles passing through each sieve in the range of about (−) 1180 microns to about (−) 53 microns. The cumulative volume percent of particles, dry basis, finer than ("CPFT") a particular stated sieve size in microns is charted against the sizes in microns on a log-log chart, referred to herein as a "CPFT chart", to indicate the nature of the particle size distribution of 16 mesh×270 mesh particles.

(2) A Sedigraph 5500L (made by Micromeritics Co., Norcross, Ga., U.S.A.) is used to measure particles sizes and numbers of particles in the carbonaceous material and in the slurry in the range of (−) 75 microns to about 0.2 millimeters. The Sedigraph 5500L uses photoextinction of settling particles dispersed in water according to Stoke's law as a means for making the above determinations. Other instruments, such as a Coulter Counter, or combinations of the Leeds & Northrup Microtrac Particle Analyzers, can also be used for similar accuracy. The results can be plotted on a CPFT chart. Although these data do not necessarily extend to the size axis at 1% CPFT, the "Ds at 1%" can be determined by extrapolating the CPFT chart line to this axis and reading the intercept. This number, although not the true Ds, can be effectively used in the computer algorithm to determine % porosity and specific surface area.

In addition to the above methods, particle size measurements can be estimated from methylene blue index measurements to obtain an approximate determination of the weight percent of colloidal particles of size below 1.0 millimeter. Such a procedure is described in A.S.T.M. Standard C837-76. This index can be compared with the surface area calculated by the CPFT algorithm.

Once the particle size distribution of the consist is determined, it is assumed that each particle in the consist is spherical with a surface area of $\pi D^2$; the diameter D of the particles in each class of particles in the consist is known; and the surface area of the particles in each class is calculated and summed.

The consist in the slurry has an interstitial porosity of less than about 20 volume percent. It is preferred that said interstitial porosity be less than about 15 volume percent, and it is even more preferred that said interstitial porosity be less than about 10 volume percent. The interstitial porosity is a function of the volume between the interstices of the particles in the slurry consist. For any given space full of particles, the interstitial porosity is equal to the "minimum theoretical viscosity" in accordance with the equation presented below.

$$\text{Minimum Theoretical Porosity} = 40\% \ (1 - [1/VA])$$

wherein VA is as defined by the following modified Westman-Hugill algorithm:

$$VA_1 = A_1X_1$$
$$VA_2 = X_1 + A_2X_2$$
$$VA_3 = X_1 + X_2 + A_3X_3$$
$$\vdots$$
$$VA_i = \sum_{j=1}^{i-1} X_j + A_iX_i$$
$$\vdots$$
$$VA_n = \sum_{j=1}^{n-1} X_j + A_nX_n$$

wherein: (1) $A_i$=the apparent volume of a mondispersion of the $i^{th}$ size particle, (2) $X_i$=the mass fraction of the $i^{th}$ size particles, (3) $VA_i$=apparent volume calculated with reference to the $i^{th}$ size particles, (4) n=number of particle sizes, and (5) VA=maximum value of $VA_i$, =apparent volume of the the mixture of n particle sizes.

To determine the insterstitial porosity of any consist, the particle size distribution of said consist can be determined by the method described above with reference to the measurement of the specific surface area. Thereafter, it is assumed that each particle in the consist is spherical, the volume of the particles is calculated in accordance with this assumption, and the interstitial porosity of the consist is then calcualted in accordance with the above formula. It is noted that this calculated porosity is less than the true porosity of a consist as measured, for example, by liquid loss due to the nonspherical morphology (shape) of the particles, and by invocation of Ds at 1%.

The slurry of this invention contains a consist which is comprised of at least 5 weight percent of colloidal particles and, preferably, from about 5 to about 70 weight percent of colloidal particles. As used herein, the term "colloidal" refers to a substance of which at least one component is subdivided physically in such a way that one or more of its dimensions lies in the range of 100 angstroms and 3 microns.

It is preferred that, in the slurry consist, at least 5 weight percent of the carbonaceous particles are smaller than 3 microns. It is more preferred that from about 5 to about 70 weight percent of these carbonaceous particles be smaller than 3 microns.

In one embodiment, the particles in the slurry consist have a particle size distribution in accordance with the following formula:

$$\frac{CPFT}{100} = \sum_{j=1}^{k}\left[X_j\left(\frac{D^{Nj} - D_{sj}^{Nj}}{D_{Lj}^{Nj} - D_{sj}^{Nj}}\right)\right]$$

where $\sum_{j=1}^{k} X_j = 1.0$ and where if $D < D_{sj}$ $\left(\frac{D^{Nj} - D_{sj}^{Nj}}{D_{Lj}^{Nj} = D_{sj}^{Nj}}\right) = 0.0$ -continued and where if $D > D_{Lj}$ $\left(\frac{D^{Nj} - D_{sj}^{Nj}}{D_{Lj}^{Nj} - D_{sj}^{Nj}}\right) = 1.0$ wherein:

(1) CPFT is the cumulative percent of the carbonaceous solid finer than a certain particle size D, in volume percent.

(2) k is the number of component distributions in the consist, is at least 1, and preferably is from about 1 to about 30, and most preferably is 1.

(3) $X_j$ is the fractional amount of the component j in the consist, is less than or equal to 1, and the sum of all $X_j$'s in the consist is 1.0.

(4) n is the distribution modulus of fraction j, is greater than about 0.001, preferably is from about 0.001 to about 10.0, more preferably is from about 0.01 to about 1.0, and most preferably is from abohut 0.01 to about 0.5.

(5) D is the diameter of any particle in the consist and ranges from about 0.05 to about 1180 microns.

(6) $D_s$ is the diameter of the smallest particle in fraction j (as measured by extrapolating the CPFT chart line, if necessary, to one percent CPFT using data from sieve analyses plus the Micromeritics Sedigraph 5500L) and is generally greater than 0.05 microns but is less than $D_L$.

(7) $D_L$ represents the diameter of the largest particle in fraction j (sieve size or its equivalent), it ranges from about 10 to 1180 microns, preferably is from about 30 to about 420 microns, and most preferably is from about 100 to about 300 microns. $D_L$ is the theoretical size modulus of the particle size distribution; when CPFT is plotted against size, the $D_L$ value is indicated as the intercept on the upper X axis of the CPFT/D plot. However, as is known to those skilled in the art, because of aberrations in grinding the coarse end of a particle size distribution, the actual top particle size is always larger than the $D_L$ obtained by, e.g., the particle size equation described in this case; thus, e.g., a $D_L$ size modulus of 250 microns will usually produce a particle size distribution with at least about 98 percent of the particles smaller than 300 microns. Consequently, the slurry of this invention has a particle size distribution which is substantially in accordance with the CPFT equation; minor deviations caused by the the actual top size being greater than the $D_L$ are comprehended.

In one preferred embodiment, at least about 85 weight percent of the carbonaceous particles in the slurry of this invention are smaller than 300 microns. In a more preferred embodiment, at least 90 weight percent of the carbonaceous particles in the slurry have a particle size smaller than 300 microns. In the most preferred embodiment, at least about 95 weight percent of the carbonaceous particles in the slurry have a particle size less than 300 microns.

The preferred carrier liquid used in the slurry of this invention is water. When the carrier liquid is water, it is preferred that the colloidal sized carbonaceous particles in the slurry have a net zeta potential of from about 15 to about 85 millivolts. The following discussion will refer to a coal-water slurry, it being understood that the discussion is equally applicable to, e.g., coke-water slurries, graphite-water slurries, etc.

It is preferred that the colloidal sized particles of coal in the coal-water slurry have a net zeta potential of from about 15 to about 85 millivolts. As used herein, the term "zeta potential" refers to the net potential, be it positive or negative in charge; thus, a zeta potential of from about 15.4 to about 70.2 millivolts includes zeta potentials of from about −15.4 to about −70.2 millivolts as well as zeta potentials of from about +15.4 to about +70.2 millivolts. In a more preferred embodiment, said zeta potential is from about 30 to about 70 millivolts.

As used in this specification, the term "zeta potential" has the meaning given to it in the field of colloid chemistry. Concise discussions and descriptions of the zeta potential and methods for its measurement are found in many sources including U.S. Pat. Nos. 3,454,487 and 3,976,582; Clark et al., "Encyclopedia of Chemistry", 2d ed. (Reinhold Publishing Corp., 1966), at pages 263–265; D. M. Considine, "Chemical and Process Technology Encyclopedia" (McGraw-Hill Book Company, New York), at pages 308–309; and the like. the disclosures of the aforementined documents are hereby incorporated into this specification by reference.

"Zeta potential" may be measured by conventional techniques and apparatus' of electroosmosis, such as those described in, e.g., Potter, "Electro Chemistry" (Cleaver-Hume press, Ltd., London, 1961), the disclosure of which is hereby incorporated by reference into this specification. Zeta potential can also be determined by measuring electrophoretic mobility (EPM) in any of several commercial apparatuses. The inventor has used a Pen Kerr System 3000 (made by Pen Kem Co., Inc. of Bedford Hills, New York) for determining zeta potential. This instrument is capable of automatically taking samples of coal particles and producing an EPM distribution by Fast Fourier Transform Analysis from which the average zeta potential can be calculated in millivolts.

The zeta potential is measured using very dilute samples of the 10 micron sized coal particles in the coal compact of the coal-water slurry.

In one embodiment, it is preferred that the zeta potential of said colloidally sized coal particles be "near maximum". "Near maximum zeta potential", as used in this specification, means a value of zeta potential, measured at constant electrical conductivity, below the maximum zeta potential as defined and discussed in the references cited in this specification. In this embodiment, it is preferred that the zeta potential on the colloidal coal particles be from about 20 to about 95 percent of the maximum zeta potential. It is more preferred that the zeta potential on the colloidal coal particles be from about 40 to about 80 percent of the maximum zeta potential for this embodiment.

The maximum zeta potential may be determined by measuring the Brookfield viscosity of the slurry at different zeta potentials. For a given system, maximum zeta potential has been reached when further increases in the surfactant concentration in the slurry do not further decrease the Brookfield viscosity of the system at 100 r.p.m.

One preferred means for measuring the zeta potential is to grind a sample of coal in either a laboratory size porcelain ball mill with porcelain balls in distilled water at 30 weight percent solids for approximately 24 hours or in a steel ball mill with steel balls at 30 weight percent solids for 16 hours or until all of the particles in the coal are less than 10 microns in size. Small samples of this larger sample of this larger sample can then be prepared in a known way by placing them in a vessel equipped with a stirrer with a sample of water to be used as a carrier in the coal-water slurry. Various acidic and basic salts are then added in incremental amounts to vary the pH, and various concentrations of various candidate dispersing agent organic surfactants likewise are added in incremental amounts (e.g., grams per gram coal, both dry basis), alone or in combinations of two or more. These samples are then evaluated in any electrophoretic mobility, electroosmosis, or streaming potential apparatus to determine electrical data, from which the zeta potential is calculated in a known way. Plots of zeta potential, pH, and specific conductance vs. concentration may then be made to indicate candidate surfactants, or combinations thereof, to be used to produce the optimum dispersion of coal particles in the carrier water below the amount at which dilatency may be reached.

Several typical means of producing the slurry are illustrated in FIG. 2. In a wet grinding method, carbonaceous material is charged to crusher 10 and crusher 12. In one embodiment, it is preferred that one carbonaceous material be charged to crusher 10 and another carbonaceous material be charged to crusher 12. In another embodiment, different types of the same carbaonceous material are charged to crushers 10 and 12. In this latter embodiment, the carbonaceous material charged to crushers 10 and 12 can be, e.g., coal; thus, e.g., a coal fraction which contains less than about 30 weight percent of volatilizable hydrocarbons (such as, e.g., anthracite or low volatile bituminous coal) can be charged to crusher 10, and a coal fraction which contains more than about 35 weight percent of volatilizable hydrocarbons (such as, e.g., lignite or high volatile bituminous coal) can be charged to crusher 12.

Any of the crushers known to those skilled in the art to be useful for crushing carbonaceous material can be used as crusher 10 and/or crusher 12. The same crusher can be used for crushers 10 or 12, or different crushers can be used. Thus, by way of illustration and not limitation, one can use, e.g., a rod mill, a gyratory crusher, a roll crusher, a jaw crusher, a cage mill, and the like. Generally, the carbonaceous material is crushed to a size of about $\frac{1}{4}'' \times 0$, although coarser and finer fractions can be used.

The crushed material from crusher 10 is fed through line 14. The crushed material from crusher 12 is fed through line 16. Part or all of the crushed material from crusher 10 can be mixed with part or all of the crushed material from crusher 12 by passing the crushed material in line 14 and/or the crushed material in line 16 through transfer line 18. Alternatively, transfer line 18 can be closed, the crushed material from crusher 10 can be fed directly to mill 26, and the crushed material from crusher 12 can be fed directly to dry grinder 24.

The crushed material from either crusher 10 or 12 can be sampled and measured for pH in the pH meter 13, which will be discussed later, thus establishing a baseline for the entire control circuit discussed later.

The crushed material from crusher 10 can be fed through line 14 to mill 26. Mill 26 can either be a tumbling mill (such as a ball mill, pebble mill, rod mill, tube mill, or compartment mill), or a non-rotary ball or bead mill, such as stirred mills (including the Sweco dispersion mill, the Attritor, the Bureau of Mines mill described in U.S. Pat. No. 3,075,710), vibratory mills such as the Vibro-Energy mill, the Podmore-Boulton mill, the Vibratom, and the like. In general, the various processes and apparatuses which can be used to mill the crushed material are well known to those skilled in the art and are described in, e.g., Perry and Chilton's "Chemical Engineer's Handbook", Fifth Edition (McGraw Hill, New York, 1973), at pages 8–16 to 8–44, the disclosure of which is hereby incorporated by reference into this specification.

In one preferred embodiment, mill 26 is a ball mill which, preferably, is run at a reduced critical speed. In this embodiment, the mixture is ground at said high solids content of from about 60 to about 82 volume percent of carbonaceous material and at a ball mill speed of from about 50 to about 70 percent of the ball mill critical speed. It is more preferred to run the mill at less than about 60 percent of its critical speed and, even more preferably, at less than about 55 percent of its critical speed.

In general, mill 26 will have sufficient carbonaceous material and liquid fed to it so that it will contain from about 60 to about 82 volume percent of carbonaceous material. Crushed material is fed to mill 26 through line 14. Alternatively, or additionally, milled carbonaceous material (which might or might not contain carrier liquid, such as water) from mill 26 can be recycled through line 40 back into mill 26; this recycled milled carbonaceous material can be either fine milled material which passes through a sieve bend 38 and/or coarser milled material which does not pass through sieve bend 38. Alternatively, or additionally, milled carbonaceous material from mill 46 (which preferably contains carrier liquid) can be recycled into mill 26 through lines 48, 58, and 60, or into mill 46 through line 61. Alternatively, or additionally, carbonaceous material (which preferably contains carrier liquid) which has been mixed in high shear mixer 64 can be recycled back into mill 26 through lines 66 and 60, or into mill 46 through line 61.

Carrier liquid is fed to mill 26 through line 20. A sufficient amount of said carrier liquid is fed into the mill 26 so that, in combination with all of the other feeds to mill 26, a solid-liquid mixture which contains from about 60 to about 82 volume percent of carbonaceous material is produced.

The mill 26 will have sufficient solids and liquid fed to it so that it will contain from about 60 to about 82 volume percent of solid carbonaceous material. Generally, one should charge from about 0 to about 10 volume percent more solid carbonaceous material to mill 26 than he desires in the final slurry product, subject to the qualification that in no event should more than 82 volume percent of such material be charged to the mill.

Dispersing agent can be added to mill 26 through line 22. For a given material, dispersant, and solids content, a given amount of dispersant will optimize zeta potential; and this amount can be determined in accordance with the screening tests described in this specification. In general, a sufficient amount of dispersant is added through line 22 and/or line 62 and/or line 88 so that the slurry in mill 26 contains from about 0.01 to about 4.0 weight percent of one or more dispersing agents, based on weight of dry carbonaceous material.

A portion of the milled slurry from mill 26 is passed via line 28 through viscometer 30, density meter 32, pH meter 33, and line 27 back to line 28; a portion of the slurry passed to density meter 32 is also passed to particle size distribution analyzer 34. The function of viscometer 30, density meter 32, pH meter 33, and particle size distribution analyzer 34 is to continually monitor the quality of the slurry being produced in mill 26 so that, if necessary, the process can be adjusted by adjusting the feed of solids and/or solids-fluid slurry and/or liquid and/or dispersant and/or ground carbonaceous material to the mill.

Any of the viscometers known to those skilled in the art can be used as viscometer 30. Thus, by way of illustration, one can use a Nametre Viscometer. The viscometer 30 indicates the viscosity of the ground slurry. If the viscosity of the ground slurry is higher than desired, then either mill 26 is not grinding the coal to produce a sufficiently high surface area and low porosity, and/or the amount or type of dispersing agent used is insufficient to produce a sufficiently high zeta potential on the colloidal carbonaceous particles; and the underflow slurry should be subjected to further tests (in density meter 32, ph meter 33, and particle size distribution analyzer 34).

Any of the density meters known to those skilled in the art can be used as density meter 32. Density meter 32 indicates the density of the slurry, which directly varies with its solids content. If the density of the slurry is lower or higher than desired, then it is possible that the particle size distribution of the carbonaceous compact in the underflow slurry is lower or higher than desired. In this case, the slurry should be subjected to further tests in particle size analyzer 34 to determine what the particle size distribution of the underflow slurry is and what its attendant specific surface area and interstitial porosity are.

Any of the ph meters known to those skilled in the art, such as, e.g., Leeds & Northrup's in-line ph meter, can be used as ph meter 33. The ph meter measures the hydrogen ion concentration of the slurry, which can vary with water qualtiy, the oxidation state of the carbonaceous or pyrite surfaces in the slurry, soluble ingredients within the carbonaceous material, or errors in dispersant addition.

Particle size distribution analyzer 34 analyzes the particle size distribution of the compact of the underflow slurry. Any of the particle size distribution analyzers knoiwn to those skilled in the art such as, e.g., Micromeritics Sedigraph 5500L, Coulter Counter, Leeds and Northrup Microtrac Particle Analyzers, can be used as analyzer 34. From the data generated by analyzer 34, the specific surface area and the porosity of the compact of underflow slurry can be determined.

Ground slurry from mill 26 is passed through line 28 to sieve bend 38. Sieve bend 38 may be 40 mesh sieve which, preferably, allows underflow slurry of sufficient fineness (such as, e.g., less than 420 microns) through to line 29 into mill 46 where it is subjected to further grinding; alternatively, all or part of this fine ground slurry can be recycled into mill 26 via line 40. Overflow particles which are greater than 420 microns are recycled via line 40 back into mill 26, where they are subjected to further grinding.

The ground slurry from mill 26 which passes through sieve bend 38 can be passed through line 29 to mill 46. Mill 46 can be a rod mill, a ball mill, or a stirred ball mill; it preferably is a ball mill. It is preferred that the slurry be passed to mill 46 until at least about 95 volume percent of the particles in the slurry have diameters less than about 20 microns, and, more preferably, less than about 15 microns; in the most preferred embodiment, the slurry in mill 46 is ground until at least 95 volume percent of the particles in the slurry have diameters less than about 5 microns. Additional liquid and/or dispersant can be added to mill 46 via line 59 if necessary.

A portion of the ground slurry from mill 46 is passed through a control circuit comprised of viscometer 50, density meter 52, pH meter 53, particle size distribution analyzer 54, and line 56, wherein the slurry is analyzed as described above for the slurry passing from line 28 into viscometer 30, density meter 32, pH meter 33, and particle size distribution analyzer 34. The feed to mill 46 can be adjusted, as required, by feeding crushed carbonaceous material from a dry grinding mill 24 and/or by adjusting the feeds to mill 26.

Slurry from density meter 52 is returned through line 56 to line 48. Part or all of ground slurry from mill 46 can be passed through lines 48, 58, and 60 back to mill 26, where it is fed as a recycle stream. Alternatively, or additionally, part or all of ground slurry from mill 46 can be passed via line 61 to mill 46 as a recycle stream. Alternatively, or additionally, part or all of ground slurry from mill 46 can be passed into mixer 64.

Mixers 64 and 86 can be any of the mixers known to those skilled in the art. Thus, e.g., either or both of these mixers can be a low-shear mixer such as, e.g., a low-speed agitator. Thus, e.g., either or both of these mixers can be a high-shear mixer. Thus, e.g., any of the mixers disclosed on pages 19–3 to 19–26 of Robert H. Perry and Cecil H. Chilton's "Chemical Engineers' Handbook", Fifth Edition (McGraw-Hill Book Company, New York, 1973) can be used as mixers 64 and/or 86. The disclosure of pages 19–3 to 19–26 of the Perry and Chilton book is hereby incorporated by reference into this specification.

In one preferred embodiment, at least one of mixers 64 and 86 is a high shear mixer. In an even more preferred embodiment, both of mixers 64 and 86 are high shear mixers.

Any of the high shear, high intensity mixers known to those skilled in the art can be used as mixer 64 and/or mixer 86. Thus, by way of illustration and not limitation, one can use as a high-shear mixer a Tekmar mixer, a Greerco mixer, a Banbury mixer, a Prodex-Henscel mixer, a Welex-Papenmeir mixer, and the like. These high-shear, intensive mixers are described on page 19–17 of Perry and Chilton's "Chemical Engineers' Handbook", Fifth Edition, supra, the disclosure of which is hereby incorporated by reference into this specification.

When a high shear mixer is used as mixer 64 and/or mixer 86, it is preferred that the shear rate be less than 20,000 sec.$^{-1}$, and preferably from about 200 to about 20,000 sec.$^{-1}$. In one embodiment, the shear rate is from about 1,000 to about 10,000 sec.$^{-1}$.

When a high shear mixer is used as mixer 64 and/or mixer 86, the mixing time used with each high shear mixer should be from about 0.1 to about 5.0 minutes and, preferably, from about 0.2 to about 4.0 minutes.

Each of mixing systems 64 and 86 can be comprised of one or more than one mixers. Thus, e.g., mixer system 64 and/or mixer system 86 can be comprised of one high shear mixer. Alternatively, either mixer system 64 and/or mixer system 86 can be comprised of a series of mixers. Thus, e.g., either mixer 64 and/or mixer 86 can be a series of mixer heads. Thus, e.g., either mixer 64 and/or mixer 86 can be a series of mixers within a pumping loop.

Dispersing agent is passed through line 62 to mixer 64 to optimize the zeta potential of the colloidal particles of the slurry in the mixer. A sufficient amount of dispersing agent is charged to this mixer so that the final coal slurry product contains from about 0.01 to about 4.0 weight percent of dispersant, based on the weight of dry coal.

Some or all of the product from mixer 64 can be recycled via lines 66 and 60 to ball mill 26, or via line 61 to mill 46. Alternatively, or additionally, some or all of the product from mixer 64 can be fed through line 68 to hopper 70 and thence to Moyno pump 74 for volumetric blending.

The "Moyno pump", also referred to as a "progressive cavity" or "moving cavity" pump, is well known to those skilled in the art. It consists of a convoluted hardened steel rotor and an inverse convoluted elastomeric stator so designed that as the rotor turns it maintains full contact with the stator one one side and only point to point contact with the stator on the other side. This produces a sealed cavity which moves in the direction of discharge as the rotor turns. Using a variable speed drive this pump can deliver variable volume flow rates at reasonable pressures and at high viscosities. Using a pair of pumps as 74 and 75 allows accurate blending volumetrically of two converging streams of fluids. This is described on pages 19–14 to 19–23 of Perry and Chilton's "Chemical Engineers' Handbook", Fifth Edition, supra, the disclosure of which is hereby incorporated by reference into this specification.

The function of the Moyno pump is to deliver the proper volumetric proportions of two streams from lines 68 and 42 or hoppers 70 and 72 to line 73 to low shear blender 76 via line 73. The blend from blender 76 is then transferred fiva line 77 using Moyno pump 78 through line 80 to cleaning apparatus 82.

Material from Moyno pump 74 can be fed through line 73 to low shear blender 76. Any of the low shear blenders known to those skilled in the art can be used as low shear blender 76; alternatively, or additionally, the low shear blender can be used as mixer 64 and/or mixer 86. Thus, by way of illustration and not limitation, one can use a twin-blade conical mixer (Atlantic Research Corp.), a double-arm kneader mixer (Baker Perkins Inc.), a helical ribbon mixer, gate mixers, Poly-Eon continuous reactors (Baker Perkins), the Rietz Extractor, Ko-Kneader (Baker Perkins), Transfer mix (Sterling Extruder Corp.), Rotofeed (Baker Perkins), ZSK (Werner-Pfleiderer), Halo-flite Processor (Joy Mfg. Co.), Kneadermaster (Patterson Industries, Inc.), etc. Thereafter, the product from low shear blender 76 can be fed through line 77 to Moyno pump 78 and thence through line 80 to cleaner 82.

Cleaned slurry from cleaner 82 can be passed through line 83 to mixer 86. Alternatively, or additionally, cleaner 82 can be bypassed in whole or in part and product from Moyno pump 78 and/or mill 24 can be passed through lines 17 and 84 to mixer 86. Required amounts of dispersant and liquid are fed in lines 88 and 90, respectively, to the mixer 86. A final control circuit, comprised of viscometer 94, density meter 96, line 92, particle size distribution analyzer 98, zeta meter 100, ash and sulfur analyzer 102, and ph meter 103, allows one to analyze a portion of the slurry being produced in mixer 86 so that appropriate adjustments can be made in the feeds.

Any of the zerta meters known to those skilled in the art can be used as zeta meter 100. Similarly, any of the ash and sulfur analyzers known to those skilled in the art can be used as analyzer 102.

FIG. 2 also illustrates a dry grinding process for making the slurry. In this process, which may be used separately and/or in conjunction with the wet grinding process, crushed solid carbonaceous material from crusher 12 is passed through line 16 to dry grinder 24; part or all of the material from crusher 12 may alternatively be passed through transfer line 18 to be mixed with solid carbonaceous material from crusher 10 and thence passed through line 14 to mill 26. Any of the dry grinders known to those skilled in the art can be used as grinder 24. Thus, by way of illustration and not limitation, one can use a hammer mill. Thus, e.g., one can also use ball mills or the ring roller mills described on pages 8-33 and 8-34 of Perry and Chilton's "Chemical Engineers' Handbook", Fifth Edition, supra, the disclosure of which is hereby incorporated by reference into this case. It is preferred to grind the crushed material in dry grinder 24 until it is pulverized, that is, until it is a consist of about 40 mesh by 0.

The pulverized solid carbonaceous material from dry grinder 24 can be passed through line 44 to mill 46 wherein it may be mixed with feed from line 29 (or, alternatively, not mixed with any such additional feed) and thereafter processed as described hereinabove. Alternatively, or additionally, part or all of the pulverized material from dry grinder 24 can be passsed through line 15 and line 14 to mill 26. Alternatively, or additionally, part or all of the pulverized carbonaceous material from dry grinder 24 can be passed through line 17 and fed directly into mixer 86, where it is blended with liquid and dispersant and mixed to make carbonaceous slurry.

In another embodiment, illustrated in FIG. 2, part or all of the underflow slurry which passes thorugh sieve 38 can be passed through line 42 to hopper 72 and thence to Moyno pump 75. The product from Moyno pump 75 is then passed thorugh line 73 to low shear blender 76 and processed as described above.

The operation of the control circuit comprised of viscometer 94, density meter 96, particle size distribution analyzer 98, zeta meter 100, and ash and sulfur analyzer 102 will now be described, it being understood that the other control circuits in the process operate in a similar manner.

In FIG. 2, control circuits are shown which are comprised of a viscometer, a densitometer, a particle size analyzer, and a pH meter. As will be apparent to those skilled in the art, fewer or more such control circuits can be used in the process, and the control circuits can be located at points in the process other than those indicated in FIG. 2.

If the density of the slurry is not within the target range, or if the viscosity is too low, then the control circuit determines this and adjsuts the ratio of the solids flow rate in the process to the liquids flow rate in the process, thereby adjusting the solids/liquids ratio.

If the viscosity of the slurry is higher than the target range, the the control circuit determines this and adjusts the dispersant concentration (insufficient dispersant can cause a viscosity increase), the solid and/or the liquid flow rate (an insufficient liquid flow rate will cause the solids/liquids ratio to be too high, and will thus cause the viscosity to increase), the pH (if the pH of the grinding mixture is too low, the viscosity might be too high), and/or the particle size distribution. The pH of the grinding mixture can be adjusted by adding more dispersant and/or a pH adjusting agent such as, e.g. caustic or ammonium hydroxide. It is to be understood that all of these factors are interrelated and that the control circuit can, and preferably does, monitor and adjust all of these factors simultaneously.

For any given solids-liquid system, the target particle size distribution can be determined by analyzing "ideal slurry" (i.e., one which has the desired high solids content and low viscosity) and determining its particle size distribution. The particle size distribution of this "ideal slurry" can be determined, e.g., on two Leeds and Northrup Microtrac Particle Analyzers—the Extended Range Analyzer (300 to 3 microns), and the Small Particle Analyzer (21 to 0.1 microns). The percent of the particles in the slurry consist which are less than 300 microns, 212 microns, 150 microns, 106 microns, 75 microns, 53 microns, 38 microns, 27 microns, etc. can be determined. Then, armed with this particle size profile for the ideal slurry, the particle size analyzer in the control circuit can continually analyze the particle size distribution of the slurry in the process and, if it is less than ideal, the control circuit can adjust the process accordingly. In general, the percent of the particles in the slurry consist which are less than a certain specified particle size can be adjusted by adjusting the feed rates of the solids and the liquids fed to the system. For example, if the particle size analyzer indicates that the percent of particles in the consist less than 212 mcirons is not within the target range, this can be adjusted by varying the dry carbonaceous material feed rate. For another example, a change in the entire particle size distribution of the slurry consist, including the percent less than 212 microns, can be made by varying the solids/liquids ratio, thereby adjusting the volume percent solids in the grinding mixture.

Of particular importance in the particle size distribution analysis is the control of the specific surface area of the slurry consist. The specific surface area of the consist in the slurry is proportional to the difference between the weight percent concentrations of two selected channels in the Microtrac SPA analyzer; the difference between the weight percent of, e.g., particles less than 1.01 and 0.34 microns can be determined for the aforementioned "ideal slurry"; and, armed with this "ideal difference", the particle size analyzer can continually determine this difference for the slurry in the process; and, if it varies from the ideal, the control circuit can adjust the relative feed rates of the solids and liquids fed to the system.

If the viscosity of the slurry is higher than the target rate, the control circuit determines this and can adjust the dispersant concentration and/or the solid flow rate and/or the liquid flow rate and/or the pH. Alternatively, or additionally, the control circuit can adjust the amount of reground carbonaceous fine material being recycled to the grinding mill; an insufficient amount of colloidally sized carbonaceous material in the slurry consist will cause the viscosity of the slurry consist to be too high, and the addition of finely ground carbonaceous material to such a slurry tends to reduce its viscosity.

It is preferred that the slurry have a pH of from about 5 to about 12 and, preferably, from about 7 to about 11.

The following examples are presented to illustrate the claimed invention but are not to be deemed limitative thereof. Unless otherwise stated, all parts are by weight and all temperatures are in degrees centigrade.

EXAMPLE 1—PROCEDURE FOR SCREENING DISPERSING AGENTS

A surfactant, or combination of surfactants, effective for use in preparing carbonaceous slurry, may be found by the following method.

In general, a sample of coal is ground in a laboratory size porcelain ball mill with porcelain balls in water at 30 wgt. % solids for approximately 24 hours to insure that all the particles are smaller than 10 microns. Small samples of this larger sample are then prepared in a known way by placing them in a vessel equipped with a stirrer with a sample of water to be used as a carrier in the coal-water slurry. Various acidic and basic salts are then added in incremental amounts to vary the pH, and various concentrations of various candidate dispersing agents are likewise added in incremental amounts (e.g., grams per gram coal, both dry basis) alone or in combinations of two or more. These samples are then evaluated in any electrophoretic mobility, electroosomosis, or streaming potential apparatus to measure electrical potentials, from which the zeta potential is calculated in a known way.

Plots of zeta potential vs. pH vs. concentration may then be made to indicate candidate surfactants, or combinations thereof, to be used to produce the optimum dispersion of coal particles in the carrier water below the amouunt at which dilatency may be reached. A Pen Kem System 300 apparatus was used in the determination described and can process 40 samples in about 6 hours.

EXAMPLE 2—PREPARATION OF COAL SAMPLES FOR SIZE MEASUREMENTS (a) Sieve analysis Although any standard procedure may be used to measure particle sizes of coal particles from a coal and then to calculate the particle size distribution, the procedure used in obtaining data discussed herein will be described.

A weighed sample, e.g., 50 grams dry wgt. of coal, is dispersed in 400 m.l. of carrier water containing 1.0 wgt.% Lomar D based on the weight of dry coal, dry basis, and the slurry is mixed for 10 minutes with a Hamilton Beach mixer. The sample is then allowed to stand quiescent for 4 hours, or preferably, overnight. (This step usually is not necessary if the slurry was milled with surfactant).

The sample is then remixed very briefly. It then is poured slowly on a stack of tared U.S. Standard sieves over a large vessel. The sample is carefully washed with running water through the top sieve with the rest of the stack intact until all sievable material on that sieve is washed through the sieve into the underlying sieves. The top sieve is then removed and each sieve in the stack, as it becomes the top sieve, is successively washed and removed until each sieve has been washed. The sieves are then dried in a dryer at 105 degrees centigrade, and the residue on each is weighed in a known way.

The sample which passed through the finest sieve was collected as a dilute slurry in a container for Sedigraph analysis.

(b) Sedigraph analysis

The sample finer than the smallest sieve size is carefully stirred and a representative sample (about 200 m.l.) is taken for analysis. The rest may be discarded.

About 2 eyedroppers of the dilute slurry is further diluted in 30 m.l. of distilled water with 4 drops of Lomar D added. This sample is stirred overnight with a magnetic stirrer. Measurement is then made with the Sedigraph 5500L.

EXAMPLE 3

Figure 3:
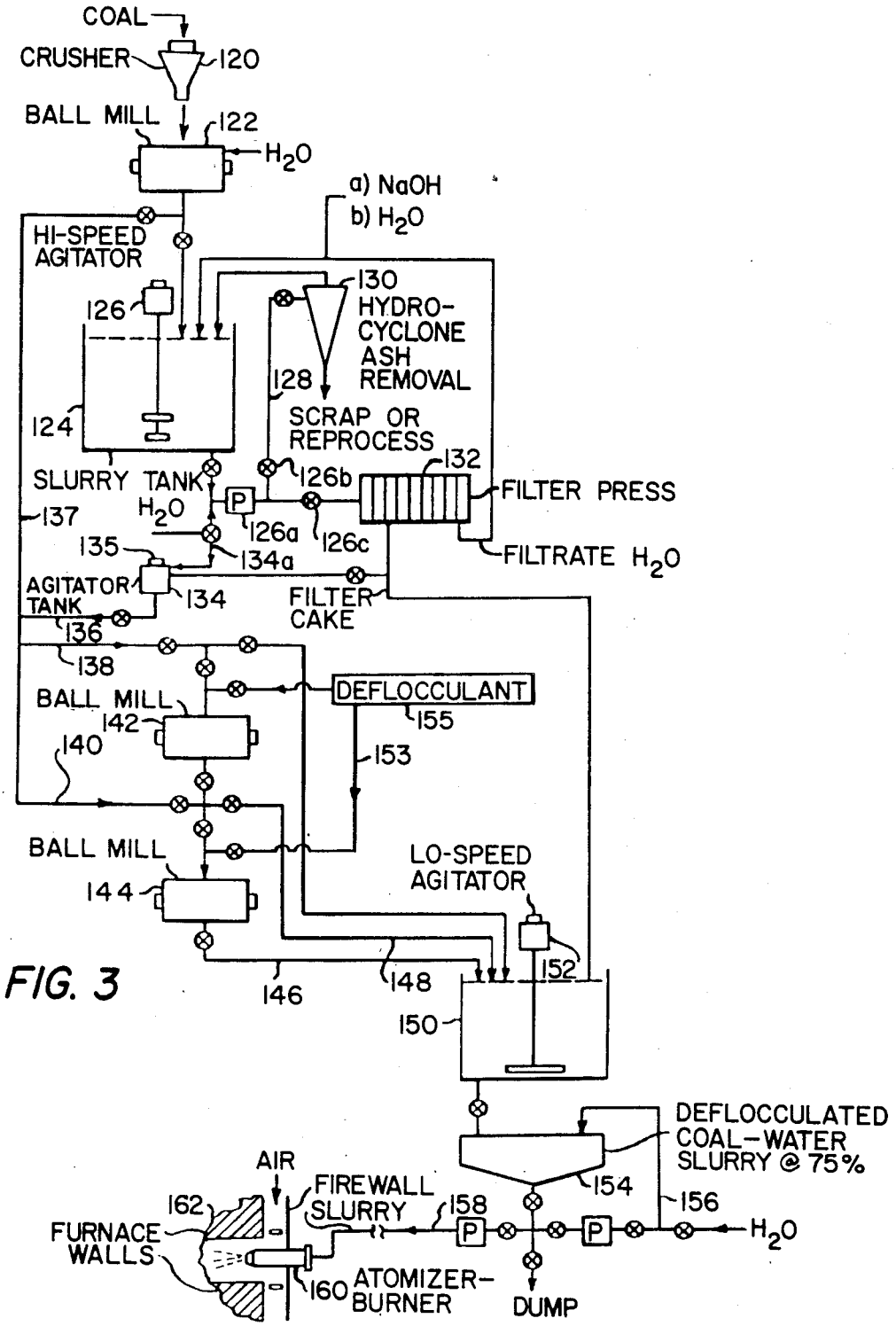
FIG. 3 is a flow sheet of another preferred process for making the slurry used in the process of the invention.

The practice of the invention in an integrated process for plant scale operation with de-ashing of West Virginia coal will now be described with reference to FIG. 3.

Bituminous coal from West Virginia, containing about 21% ash as mined or washed, is introduced into a crusher 120 wherein it is crushed to about 2" size or less. The term "ash" is used herein to define non-combustible content of the coal, such as clay and various minerals. The crushed coal is charged into a mill 122, preferably a ball mill, wherein it is wet milled to a particle size of about 70% (−) 200 mesh (−) 75 microns, with about 7% (−) 3 microns to provide a coarse fraction of coal particles suitable for preparing a coal compact when mixed with the fine grind portion made as described later herein.

The particles of coarse milled coal are then charged to a slurry tank 124 containing carrier water in an amount sufficient to maintain a solids content of about 10% by weight. The pH of the mass in tank 124 is maintained at a pH of 10 or higher by the addition of a solution of sodium hydroxide to cause deflocculation and separation of ash minerals. Tank 124 is provided with a high intensity agitator 126 to effect dispersion of all particles. After about 20 minutes agitation, the slurry is continuously pumped by pump **126*a* through line 128 through the hydrocyclone 130 and hence back to tank 124. The hydrocyclone 130 removes the higher specific gravity minerals, referably flocculated, and delivers them to scrap or reprocessing. After a suitable time of cycling the slurry through the hydrocyclone to maximize ash removal, the valve 126*b* is closed and valve 126*c* opened to filter press 132 to filter the batch from tank 124. Filtrate from filter press 132 is recycled to tank 124. The pH of the water is adjusted by addition of a solution of caustic soda (NaOH). The partially ash-free coal thus obtained contains from about 0.5 to 10 wgt. % of ash. Treatment of the coal in tank 124** is, however, beneficial to remove at least gross amounts of the ash content of the coal, thereby increasing the net bt value of the coal-water slurry.

A minor fraction of the filter cake from filter 132 containing filtered coal and about 25 wgt. % water is discharged to a second slurry tank 134 where the cake may be diluted with water from line **134*a*, if water is needed, and is agitated by means of a low-speed agitator 135 operated as in tank 124. The filter cake is dispersed in tank 134 with sufficient water present to later make a final coal-water slurry of about 75 wgt. % solids after adding a first predetermined amount of deflocculant, further milling this minor fraction of coal to a fine grind, and blending it with a major fraction of filtered coal from filter press 132 in a third slurry tank 150. The coal-water slurry from tank 134 is discharged through line 136 into line 137 from which it is fed into lines 138 and 140 leading to ball mills 142 and 144. A final predetermined amount if a solution of mixed deflocculants, usually making a total amount providing about 0.7 wgt. % of Lomar D and 0.7 wgt. % of NaOH and usually sufficient to adjust the zeta potential of the particles to near maximum zeta potential and to disperse the particles, based on the total amount of dry coal in the final coal-water slurry to be made in tank 150, is added to the coal-water slurries in ball mills 142 and 144. The ball mills preferably are steel and are loaded with steel balls. The coal is milled to a fine grind about 95 wgt. % (−) 40 microns×about 10 wgt. % (−) 3 microns. The milled, fine grind coal is discharged from ball mills 142 and 144 through lines 146 and 148 into tank 150 where it is blended and agitated by means of agitator 152 with the major fraction of de-ashed coal from filter press 132**. The coarse and fine grind coals are blended in proportions such that the blend has 75 wgt. % of coal, dry basis, and the coal particles have a substantially non-undualting Alfred formula coal consist having about 10 wgt. % of coal particles (−) 3 microns and the particles have a particle size range of about 300 microns×0.1 microns. The resulting final coal-water slurry product is a pipeline pumpable 75 wgt. % low viscosity Alfred formula coal-water slurry usually having a Brookfield viscosity of about 1000 to about 2000 centipoise at 60 r.p.m.

The deflocculated yield pseudoplastic coal-water slurry is discharged from tank 150 to a storage tank 154. Successive charges of the slurry are blended continuously in tank 150, preferably by pumping it continuously through a recycle pipeline 156 leading from the bottom of tank 154 to the top of tank 154. Uniformity of the slurry is thus maintained and provides slurry of substantially uniform b.t.u. content. The blended Alfred formula coal-water slurry is pumped from storage tank 154 through pipeline 158, which may be a short pipeline or a long distance pipeline, and is fed into an atomizer burner 160 of a furnace 162 used to generate heat energy to heat water in a steam boiler.

In general, as is disclosed in my U.S. Pat. No. 4,282,006 (the disclosure of which is hereby incorporated by reference into this specification), the process described in this Example can be utilized to prepare a slurry which contains from about 60 to about 80 weight percent of carbonaceous material (such as coal) and from about 20 to about 40 weight percent of carrier liquid, in which at least about 5 weight percent of the carbonaceous particles are smaller than 3.0 microns in size, which has a Brookfield viscosity (measured at 60 r.p.m.) of less than 4,000 centipoise, and whose carbonaceous particles range from about 300 to about 0.1 microns in size.

It is to be understood that the foregoing description and Examples are illustrative only and that changes can be made in the ingredients and their proportions and in the sequence and combinations of process steps as well as other aspects of the invention discussed without departing from the scope of the invention as defined in the following claims.

I claim:

1. A process for preparing a carbonaceous slurry, comprising the steps of:

(a) providing a mixture of carbonaceous solid material and liquid, wherein:

1. said mixture contains at least about 60 weight percent of particles of carbonaceous solid material, no more than about 40 weight percent of liquid, and from about 0.01 to about 4.0 weight percent (by weight of dry carbonaceous material in the mixture) of dispersing agent,
2. at least about 5 weight percent of the carbonaceous solid material in said mixture are of colloidal size, being less than 3.0 microns in size,
3. the carbonaceous particles in said mixture have a particle size range of about 300×0.1 microns, and
4. the Brookfield viscosity of said mixture, when measured at 60 r.p.m., ambient temperature, and ambient pressure, is less than about 4,000 centipoise; and (b) mixing the mixture of paragraph (a).

2. The process as recited in claim 1, wherein said carbonaceous solid material is coal.

3. The process as recited in claim 2, wherein said liquid is water.

4. The process as recited in claim 3, wherein the mixture of paragraph (a) is mixed at high shear.

5. The process as recited in claim 4, wherein, during the mixing step of paragraph (b), said mixture is mixed at a shear rate of from about 200 to about 20,000 sec.$^{-1}$.

6. The process as recited in claim 5, wherein, during the mixing step of paragrpah (b), said mixture is mixed for from about 0.1 to about 5.0 minutes.

7. The process as recited in claim 6, wherein said mixture comprises a consist of finely-divided particles of coal dispersed in water, and said consist has a specific surface area of from about 0.8 to about 4.0 square meters per cubic centimeter.

8. The process as recited in claim 7, wherein the coal consist of said mixture has an interstitial porosity of less than 20 volume percent.

9. The process as recited in claim 8, wherein the coal consist of said mixture has a specific surface area of from about 0.8 to about 2.0 meters per cubic centimeter.

10. The process as recited in claim 9, wherein the coal consist of said mixture has an interstitial porosity of less than about 10 volume percent.

* * * * *